United States Patent [19]

Berfield et al.

[11] Patent Number: 4,606,563

[45] Date of Patent: Aug. 19, 1986

[54] CONDUIT FIXTURE FOR TANK WALL

[75] Inventors: Robert C. Berfield, Jersey Shore; Robert L. Crevling, Williamsport, both of Pa.

[73] Assignee: Shop-Vac Corporation, Williamsport, Pa.

[21] Appl. No.: 664,214

[22] Filed: Oct. 24, 1984

[51] Int. Cl.[4] ..... F16L 5/00

[52] U.S. Cl. ..... 285/189; 285/7; 285/194; 285/204; 285/921

[58] Field of Search ..... 285/189, 194, 205, 319, 285/7, 423, DIG. 22; 15/353; 55/DIG. 2, DIG. 3, DIG. 26; 417/423 A

[56] References Cited

U.S. PATENT DOCUMENTS

| | | | |
|---|---|---|---|
| 2,468,847 | 5/1949 | Trainor | 285/319 |
| 3,513,875 | 5/1970 | Nelson | 285/194 |
| 4,538,971 | 9/1985 | Miller et al. | 55/DIG. 3 |

FOREIGN PATENT DOCUMENTS

| | | | |
|---|---|---|---|
| 2118264 | 10/1983 | United Kingdom | 285/194 |

*Primary Examiner*—Cornelius J. Husar

*Assistant Examiner*—Douglas W. Hanson

*Attorney, Agent, or Firm*—Ostrolenk, Faber, Gerb & Soffen

[57] ABSTRACT

The disclosure concerns a two-part tubular fitting for attachment to a wall of a tank, or the like, at a hole through the wall. The first fitting part includes a tube which supports a radially directed wall at one end of the and on the fitting part wall is an axially directed flange for engaging one side of the tank wall. The second fitting part is a ring that receives the first fitting part tube and that engages the opposite side of the tank wall. A plurality of flange like, circular segment plates are circumferentially spaced around the ring. The plates extend over the tube and through the hole in the tank wall and the exterior surfaces of the plates contact the tank wall surrounding the hole. Radially inwardly directed detent hooks at the outward ends of at least some of the plates hook over respective detent walls defined on the tube underneath the axially directed flange. The detent hooks engage the detent walls for connecting the fitting parts together. Posts defined in the radially directed wall of the first fitting part index between adjacent plates and orient the first and second fitting parts.

8 Claims, 9 Drawing Figures

FIG. 2.
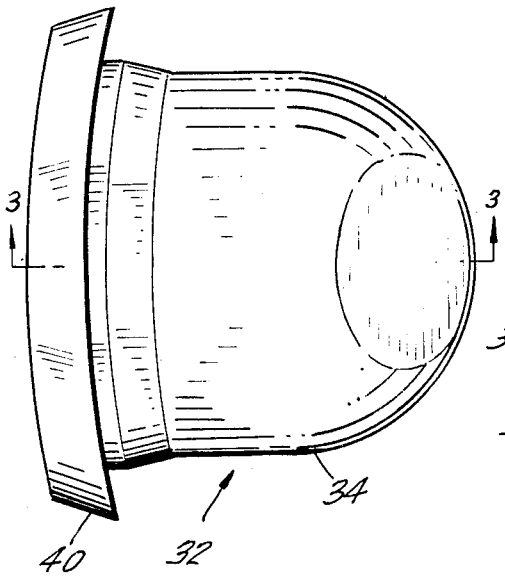
FIG. 1.
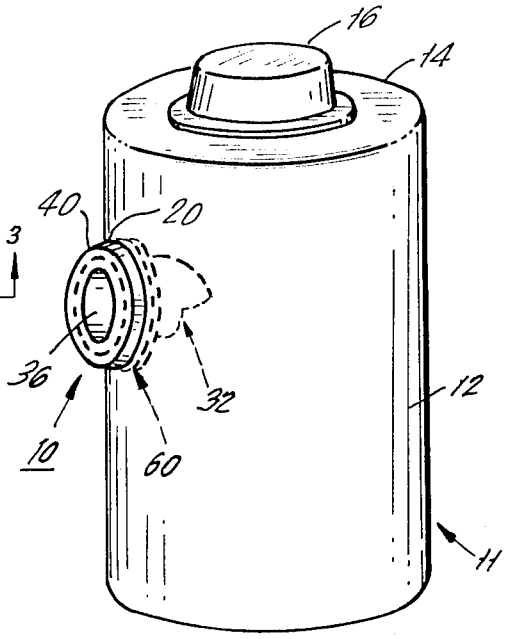
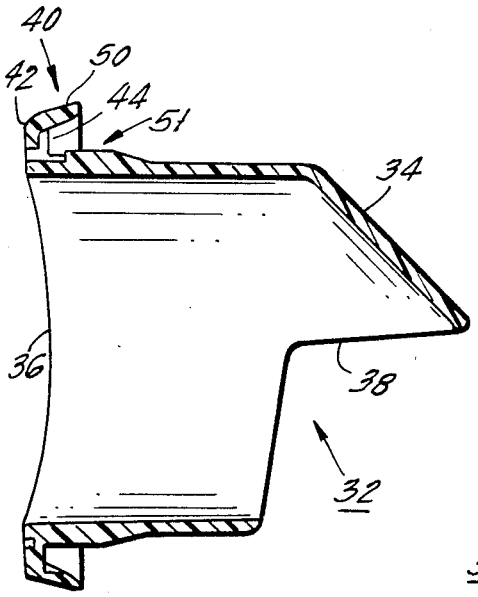
FIG. 3.
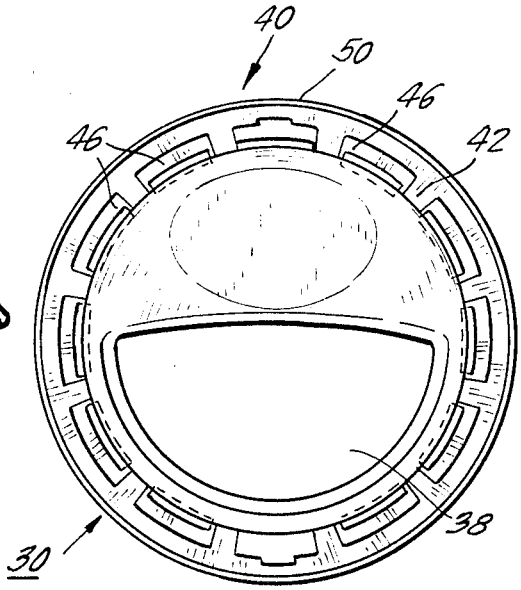
FIG. 4.

FIG. 7
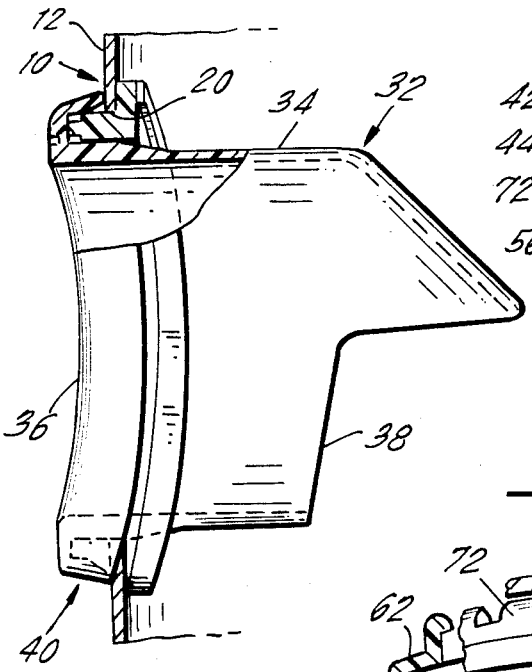
FIG. 8
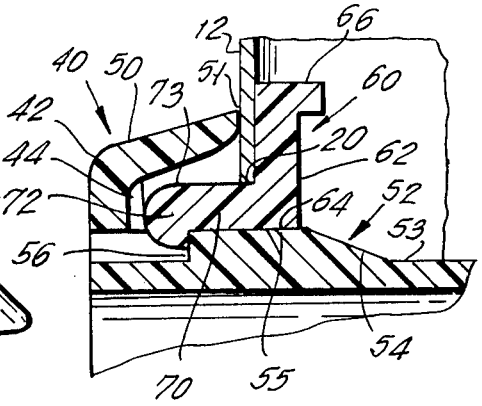
FIG. 9
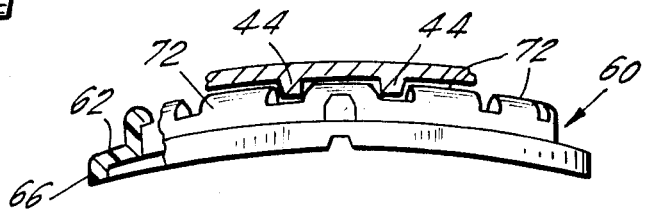
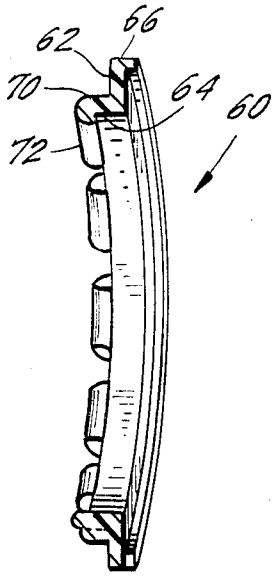
FIG. 6
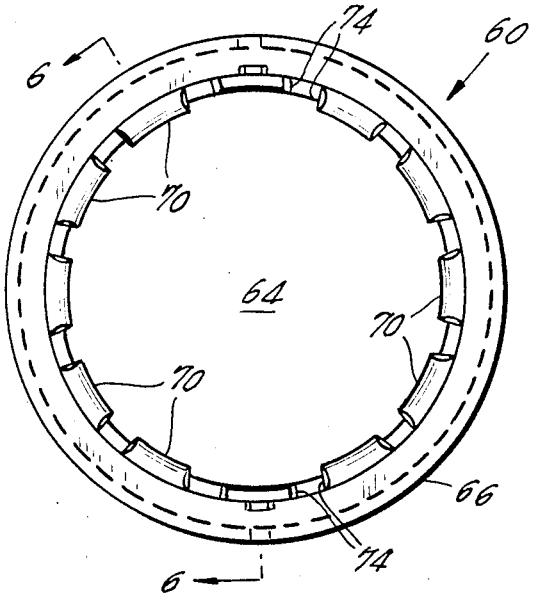
FIG. 5

CONDUIT FIXTURE FOR TANK WALL

BACKGROUND OF THE INVENTION

The present invention relates to a conduit fixture for a hole in a wall, particularly a cylindrically curved wall, and more particularly a collecting tank wall, and specifically relates to a fixture for receiving the conduit, such as a hose or a pipe, in the wall of the cylindrical tank of an electric vacuum cleaner. Although the invention will be further described herein with respect to the tank of a vacuum cleaner, the invention is not limited to use in that context.

A wall, e.g. a tank wall, often has a fitting for closing a hole in the wall, and the fitting receives a hose, pipe or other conduit to communicate from outside the tank wall to inside the wall. The fitting supports and seals the conduit. The fitting must be secured to the tank wall in the hole. Typically, such fittings are screwed or bolted into place through screws passing through a peripheral flange of the fitting and into the wall of the tank. Sometimes the fitting is secured between a flange on the fitting at one side of the wall and a ring or plate on the opposite side of the wall. But, such attachment also often requires passing a screw through the wall of the tank. Especially where the wall of the tank is steel, even rust resistant, the tank is likely to begin to rust at each spot where it has been cut, whereby avoiding the additional cuts or holes required for screws or bolts in the tank wall is desirable.

Also, whenever a fitting must be screwed or bolted into place, there are alignment problems, that is aligning the screw holes in the fitting and the tank and there are the screw insertion and tightening stops, which prolongs the assembly procedure.

Other securements of a fitting in a tank wall include various friction fits. A friction fit may have the tendency to work loose over time and is not a reliable affixation.

SUMMARY OF THE INVENTION

Accordingly, it is primary object of the present invention to provide an easy to install yet non-removable effective conduit receiving fitting for a wall, such as the wall of a tank.

It is another object of the invention to provide such a fitting which is not easily removed and will not work loose.

A further object is to provide such a fitting which is itself form locked into position to preclude its removal.

The fitting according to the invention is comprised of two parts and is installed in a hole that is preformed in a wall, particularly a cylinder wall, such as the wall of a tank of a tank-type electric vacuum cleaner. The first fitting part includes a tubular portion of an outside diameter sized smaller than the opening in the wall. This enables the flat plates projecting from the other part of the fitting, described below, to fit through the hole in the wall and over the tubular portion of the first part of the fitting for form locking the fitting parts together, as described below. The tubular portion has an outwardly projecting, wall engaging flange means around it. The flange means is generally L-shaped, having a radially outwardly extending wall portion which terminates in an axially extending portion, and the latter portion is directed toward the wall of the tank when the fitting is installed. The radially outwardly extending wall portion of the flange means has a plurality of radially extending posts or barriers at spaced intervals around the radially extending wall portion which perform a number of functions. First, they rigidify the wall portion. Secondly, they cooperate with projections on the other part of the fitting, described below, for rotationally orienting the fitting parts with respect to each other for proper form locking. Furthermore, beneath the surrounding axially extending portion of the flange means, the tubular portion has a ramp which widens toward the radially outwardly extending wall portion and terminates in a plurality of short height walls beneath the axially extending portion of the flange means for enabling detented form locking of the second fitting part with the tubular portion of the first fitting part.

The second part of the fitting comprises a ring internally sized to the external diameter of the tubular portion for fitting thereover, and the ring extending radially outwardly enabling one side thereof to abut the wall of the tank. Further, a plurality of axially extending, radially thin, ring segment shaped plates or teeth project in the direction toward the wall portion of the first fitting. These flat plates pass through the hole in the tank wall, between the tubular portion of the first part of the fitting and the cut portion of the tank wall. The plates are of such length and are shaped with hook like projections which snap over the detent means walls defined on the tubular part when the two parts of the fitting are pressed against opposite sides of the wall for form locking the parts of the fitting.

The flat plates abut the radially extending posts in the radially upstanding wall portion of the flange means of the first fitting part, and this indexes the two parts of the fitting as they are moved together so that the plates of the second part of the fitting properly orient themselves and form lock with the walls in the first part of the fitting. Also, those posts prevent relative rotation of the two parts of the fitting once they are form locked.

Other objects and features of the present invention will become apparent from the following description of a preferred embodiment of the invention taken in conjunction with the accompanying drawings.

BRIEF DESCRIPTION OF THE DRAWINGS

FIG. 1 is a perspective view of a tank type electric vacuum cleaner provided with the fitting of the invention;

FIG. 2 is a top view of a first part of the fitting of the invention;

FIG. 3 is a cross-sectional view of the fitting part of FIG. 2 along the line 3—3;

FIG. 4 is an end view of the fitting part shown in FIG. 2;

FIG. 5 is an end view of the second part of the fitting of the invention;

FIG. 6 is a cross-sectional view thereof along the arrows 6—6 of FIG. 5;

FIG. 7 is a partial cross-sectional view showing the assembly of the first and second fitting parts to a wall;

FIG. 8 is an enlarged fragment of FIG. 7 showing in cross-section the engagement between the first and second fitting parts; and FIG. 9 is a top view of the fragment shown in FIG. 8 showing the interconnection between the first and second fitting parts.

DESCRIPTION OF A PREFERRED EMBODIMENT

The fitting 10 of the present invention is intended for installation on a wall, and particularly the wall 12 of a tank, such as the metal tank 11 of an electric vacuum cleaner. The tank 12 has a lid 14 thereover in which a blow motor 16 is disposed and air and collected materials are suctioned into the tank through the circular inlet opening 20 in the tank wall.

The fitting 10 according to the invention is comprised of two parts 32 and 60 which are both injection molded of a stiff plastic material with a slight resilience that enables the parts to be deformed to be snap fitted together and to hold the fitting securely to the tank 12 and that also enables the fitting to receive the conduit, such as a hose or pipe, without suffering damage through contact with the conduit and/or through relative motion between the conduit and the fitting. The slight deformation of the flange 50 tends to push the fitting part 32 away from the tank wall to tightly form lock the two parts of the fitting together.

The first fitting part 32 includes a hollow tube 34 having an outside diameter which is slightly smaller than the inside diameter of the hole 20 through the tank 12. This permits easy insertion of the tube 34 in the opening 20 and also permits form locking of the two parts of the fitting together, as described below. The tube 34 has an inlet 36 which is outside the tank 12 and an outlet 38 which is inside the tank.

At one end of the tube 34 is integrally defined the flange means 40. The flange means is not generally in one plane, but instead is curved in shape to the curvature of the tank wall so that the flange means can seal to the tank wall. The flange means is comprised of a radially outwardly extending wall portion 42. That wall portion 42 has a plurality of integrally formed, short width, radially extending posts 44 at circumferentially spaced intervals around the wall portion 42. The posts rigidify the wall portion against bending and also serve as guides for the below described axially projecting panels on the second part 60 of the fitting, as described below. The wall portion 42 has circumferentially spaced slots 46 between at least some of the posts 44. These slots aid in the fabrication steps needed for forming the below described detent ramp 52, 55 and short height walls on the tube 34.

At the radially outward end of the wall portion 42 is defined the axially extending flange 50 which extends away from the inlet 36 and toward the outlet 38 of the tube 34. The end 51 of the flange 50 contacts the wall of the tank 12 and is pressed against it for helping to seal the fitting at the outside of the tank. Further, when the flange end 51 is pressed against the tank wall and the second part 60 of the fitting is joined to the first part 32, the flange 50 is slightly deformed and through its resilience seeks to restore itself to its undeformed condition. This has the effect of applying a positive bias between the below described detent elements to form lock the fitting parts together.

Similarly, around the tube 34 is a gradually widening ramp 52 which starts at 53 outside the flange 50, widens at 54 toward the wall portion 42 and extends widened at 55. The ramp terminates sharply at a plurality of short, radially extending detent walls 56 defined at spaced intervals around the tube 34 and facing toward the wall portion 42. The walls 56 define one of the elements of the form locking detent.

The second part 60 of the fitting comprises a ring 62 having an opening 64 through it which is sized with an inner diameter that is minimally greater than the outer diameter of the tube 34 so that the ring 62 can be slid over the tube 34. At the peripheral exterior of the ring 62 is the rearwardly extending flange 66 which strengthens the ring 62 pressed against the opposite side of the tank wall from the flange 50.

Projecting from the front side of the ring 62 at the opening 64 are the flat thickness, annular or ring segment form locking and detent plates 70. At the axially outer ends of at least some of the plates 70 are the radially inwardly projecting detent hooks 72. The placement of the plates 70 and their thickness are selected so that when the fitting part 60 is installed over the tube 34 and the ring 62 is pressed against the wall of the tank, the plates 70 pass through the tank wall opening 20 over the tube 34 and the radially exterior surfaces 73 of the plates 70 press against the tank wall 12 around the opening 20, whereby the wall 55 of the tube 34 on which the plates 70 rest, together with the plates, cooperate to tightly fit within the opening 20 and securely hold the fitting 10 in the hole 20 without freedom for any significant rocking.

As the plates 70 move over the tube 34 and toward the flange wall part 42, the plates 70 contact the posts 44. The corners or lateral sides 74 of the plates 70 taperingly incline toward each other or are chamfered so that when they contact the posts 44, they are guided by the profiles of the posts to slightly rotate the ring 62 around the tube 34, if necessary, so that the plates 70 can move along and past the posts 44 to their final locked position. The detent hooks 72 on the plates 70 ride up on the ramp 54, 55 and are guided by the posts 44 and eventually the projections 72 drop over the walls 56, thereby form locking the fitting parts together. At this time, the flange 50 is slightly deformed as the two parts of the fitting are pressed together, and this prevents the walls 56 and projections 72 from shifting apart.

The fitting is now completely assembled of two parts formed locked together. It can be assembled without preliminary indexing for insertion of fastening elements such as screws and can be easily assembled by automated equipment.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A tubular fitting for installation in a wall, or the like, wherein the wall has a hole in which the fitting is to be installed; the fitting comprising:

a first fitting part, having a tubular element with an outer diameter slightly smaller than the diameter of the hole in the wall for enabling the tubular element to fit into the hole;

first flange means on the tubular element and including a first radially outwardly projecting wall and a first axially projecting flange located radially outwardly on the first radially outwardly projecting wall and located at the side of the first radially outwardly projecting wall for contacting the wall with the hole;

first detent means on the exterior of the tubular element and located axially therealong to be radially beneath the first flange;

a second fitting part comprising a ring with an opening therein that is sized to about the diameter of the tubular element for being received on the tubular element; the ring having a side that is directed to contact the wall with the hole;

the first and second fitting parts are resilient, and the first and second detent means are placed for slightly resiliently deforming the first flange when the first and second detent means are in engagement;

radially outwardly of the opening of the ring, the ring having a plurality of generally flat thin plates which are attached to the ring and which extend axially in the direction toward the first radially outwardly projecting wall; the plates being of a length and thickness to extend along the tubular element of the first part, into and through the hole in the wall in which the tubular element is placed;

at least some of the plates including second detent means thereon which are shaped, positioned and adapted for engaging the first detent means which the first and the second fitting parts are installed in the wall with the hole, with the first flange means and the ring being on opposite sides of the wall with the hole and with the first flange and the ring contacting the wall with the hole;

each of the first detent means comprising a short, generally radially directed wall defined in the tubular element and facing away from the wall with the hole, and each of the second detent means comprising a hook projecting radially inwardly of a respective plate for engaging a respective one of the first detent means wall on the tubular element when the first and second fitting parts have been pressed together at the wall with the hole;

a plurality of radially directed posts at circumferentially spaced intervals around the first radially projecting wall of the first flange means, the posts being placed for fitting between adjacent plates on the second fitting part when the first and second fitting parts are moved to engage the first and second detent means for orienting the first and second detent means for their interengagement.

2. The tubular fitting of claim 1, wherein the entire first fitting part and the entire second fitting part are both formed of a resilient plastic material.

3. The tubular fitting of claim 1, further comprising a widened ramp on the tubular element, the ramp gradually tapering radially wider toward the first detent means walls for urging the hooks outwardly as the first and second detent means are moved together; the ramp terminating at the first detent means walls, whereby the hooks may resiliently drop radially inwardly to engage the respective first detent means walls.

4. The tubular fitting of claim 3, wherein the wall with the hole is curved with a first curvature; the flange means and the ring both having the first curvature for contacting opposite sides of the wall with the hole.

5. A tubular fitting for installation in a wall, or the like, wherein the wall has a hole in which the fitting is to be installed; the fitting comprising:

a first fitting part, having a tubular element with an outer diameter slightly smaller than the diameter of the hole in the wall for enabling the tubular element to fit into the hole;

first flange means on the tubular element and including a first radially outwardly projecting wall and a first axially projecting flange located radially outwardly on the first radially outwardly projecting wall and located at the side of the first radially outwardly projecting wall for contacting the wall with the hole;

first detent means on the exterior of the tubular element and located axially therealong to be radially beneath the first flange;

a second fitting part comprising a ring with an opening therein that is sized to about the diameter of the tubular element for being received on the tubular element; the ring having a side that is directed to contact the wall with the hole;

radially outwardly of the opening in the ring, the ring having a plurality of generally flat thin plates which are attached to the ring and which extend axially in the direction toward the first radially outwardly projecting wall; the plates being of a length and thickness to extend along the tubular element of the first part, into and through the hole in the wall in which the tubular element is placed;

at least some of the plates including second detent means thereon which are shaped, positioned and adapted for engaging the first detent means when the first and the second fitting parts are installed in the wall with the hole, with the first flange means and the ring being on opposite sides of the wall with the hole and with the first flange and the ring contacting the wall with the hole;

a plurality of radially directed posts at circumferentially spaced intervals around the first radially projecting wall of the first flange means, the posts being placed for fitting between adjacent plates on the second fitting part when the first and second fitting parts are moved to engage the first and second detent means for orienting the first and second detent means for their interengagement.

6. The tubular fitting of claim 5, further comprising the outward corners of the plates tapering toward each other for contacting with the posts.

7. The tubular fitting of claim 1, wherein the wall with the hole is curved with a first curvature; the flange means and the ring both having the first curvature for contacting opposite sides of the wall with the hole.

8. The tubular fitting of claim 7, wherein the curved wall with the hole has opposite convexly and concavely curved sides; the flange means being at the convexly curved side and the ring being at the concavely curved side.

* * * * *